United States Patent [19]

Schweiss et al.

[11] Patent Number: 4,726,897

[45] Date of Patent: Feb. 23, 1988

[54] FLOTATION CONTAINER OR CELL

[75] Inventors: Peter Schweiss, Langenau; Hans-Dieter Dorflinger; Hans-Otto Henrich, both of Heidenheim, all of Fed. Rep. of Germany

[73] Assignee: J. M. Voith, GmbH, Heidenheim, Fed. Rep. of Germany

[21] Appl. No.: 36,082

[22] Filed: Apr. 9, 1987

[30] Foreign Application Priority Data

May 2, 1986 [DE] Fed. Rep. of Germany ..... 3614933

[51] Int. Cl.[4] ..... B03D 1/24

[52] U.S. Cl. ..... 209/170; 210/221.2; 261/123; 261/DIG. 75

[58] Field of Search ..... 210/703–706, 210/219, 220, 221.2; 209/162–170; 261/123, DIG. 75

[56] References Cited

U.S. PATENT DOCUMENTS

| | | | |
|---|---|---|---|
| 4,110,210 | 8/1978 | Degner et al. | 210/221.2 X |
| 4,162,970 | 7/1979 | Zlokarnik | 261/DIG. 75 |
| 4,255,262 | 3/1981 | O'Cheskey et al. | 210/221.2 |
| 4,341,630 | 7/1982 | Mackrle et al. | 209/170 X |
| 4,347,128 | 8/1982 | Barnscheidt | 261/DIG. 75 |
| 4,477,341 | 10/1984 | Schweiss et al. | 210/221.2 X |
| 4,534,862 | 8/1985 | Zlokarnik | 261/DIG. 75 |
| 4,564,457 | 1/1986 | Cairo et al. | 210/221.2 X |
| 4,606,822 | 8/1986 | Miller | 261/DIG. 75 |

*Primary Examiner*—Tom Wyse

*Attorney, Agent, or Firm*—Jeffers, Hoffman & Niewyk

[57] ABSTRACT

A flotation cell featuring a mixing pipe which enters the suspension essentially vertically, follows the point of air intake, and generally receives the entire suspension quantity per flotation cell, the injector of the flotation cell is offset sideways relative to the vertical center axis of the round container cross-section and away from the side on which the foam removal opening and the liquid drain opening are located. The mixing pipe (1) enters the suspension only for a distance such that its discharge opening, mouth (2), is located at least at one-half the height of the level of the overflow edge (7) of the foam removal channel (8), figured from the container bottom. The liquid drain opening (9) is preferably provided in the immediate vicinity of the container bottom, with a cover plate (11) extending across the length of the flotation cell and forming a drain channel (12) into which proceeds the clean liquid through an upper (14) and a lower (13) slot.

20 Claims, 2 Drawing Figures

FLOTATION CONTAINER OR CELL

The invention concerns a flotation container for a mixing pipe. A flotation container was illustrated in German Patent disclosure No. 31 20 202.

A similar flotation container with the injector mouth arranged very close to the bottom of the flotation container is shown in U.S. Pat. No. 4,255,262. A square container was used with a foam remover on both long sides while the feeding of the liquid (suspension) from one adjacent cell to the next takes place sideways through vertical, narrow openings in the partitioning walls arranged between the individual cells.

A flotation container with an injector apparatus is shown in U.S. Pat. No. 4,110,210 and the container has the injector mouth arranged approximately halfway between the suspension level and the bottom of the container. This structure includes a square container with slanted side walls. Foam removal is provided on the straight lengthwise wall of the flotation container and the discharge direction of the injector is essentially vertical without a mixing section or a mixing pipe.

Although the use of a single injector is relatively inexpensive, flotation containers featuring single injector inflow have difficulty providing suitable flow conditions to achieve good flotation effect and good foam removal. Attempts have been made at improving the flotation effect for feeding an air-water mixture through the use of an injector operable by the venturi principle. This has the disadvantage that a dilution of the flotation suspension occurs from cell to cell when several flotation cells are successively arranged. Furthermore, the venturi principle does not yield a suitable bubble size.

The problem underlying the invention is to achieve a good flotation effect without additional dilution of the suspension at a good foam removal in a flotation container with the general above-described design.

BRIEF DESCRIPTION OF THE DRAWING

The invention will be explained hereafter with the aid of an embodiment illustrated in the drawing and in the Figures of the drawing like reference numerals identify like components.

DETAILED DESCRIPTION

Figure 1:
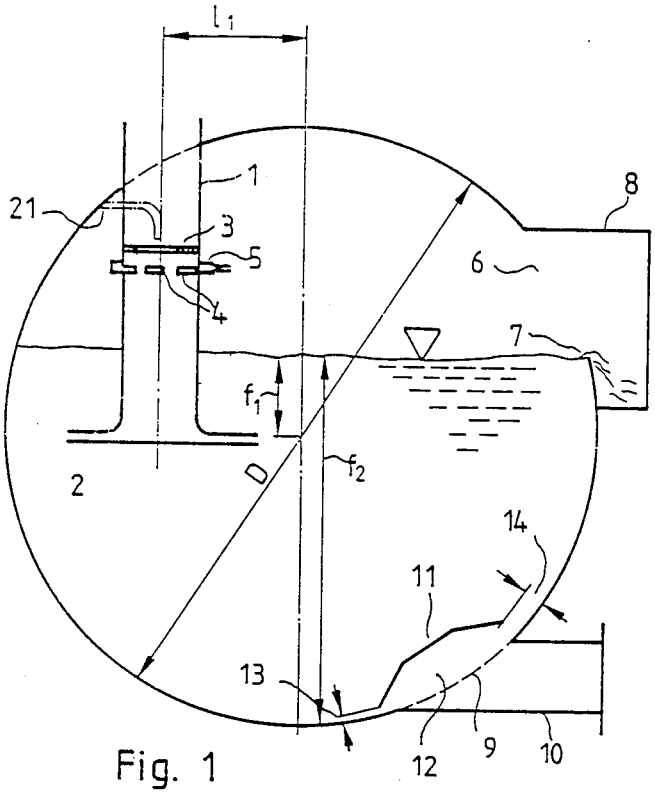
FIG. 1 shows a cross-section of a flotation container.
Figure 2:
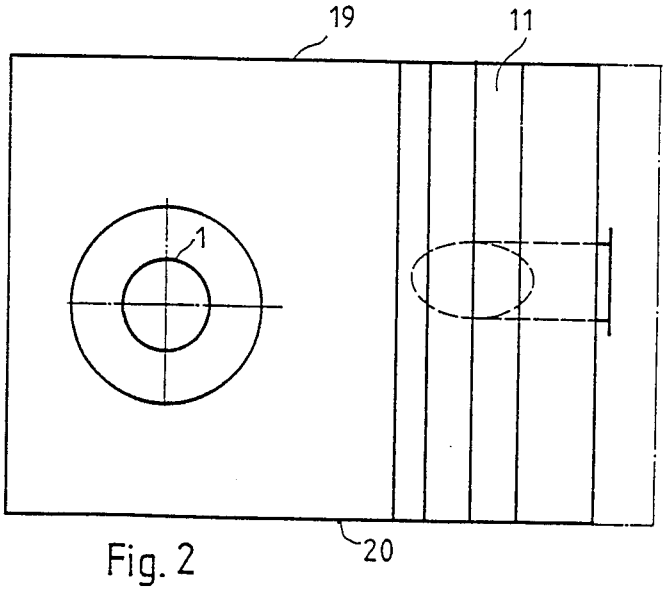
FIG. 2 is a plan view essentially of a single flotation cell.

In FIG. 1 a container is illustrated in cross-section with a fluid suspension therein. The container is illustrated as a cylinder with a circular cross-section and a vertical center axis, which generally divides the cross-section into a first half and a second half. Mixing pipe 1 essentially, vertically extends from above the container and through the container cylinder wall to enter the suspension. The mouth 2 of mixing pipe 1 is formed as a radial diffuser and is located at a considerable distance above the container bottom. The distance, $f_2$, between the suspension surface or the overflow edge 7 of the foam removal opening 6 and the container bottom being significantly greater than the distance between the mouth 2 and the container bottom or the distance, $f_1$, between mouth 2 and overflow edge 7. The ratio of the distances $f_1/f_2$ amounts to approximately between 0.3 and 0.5, and is preferably between 0.3 and 0.4.

The foam removal opening 6 routes the foam to a foam gutter 8, which extends axially along the shell of the container on the container first half. Located on the same container side as the foam gutter 8 is a liquid drain opening 9 with drain flange 10. Drain opening 9 is generally located near the container bottom. The center axis of mixing pipe 1, which feeds the entire suspension quantity to each flotation cell, is located in the second half of the container on the side opposite foam gutter 8 and drain opening 9. The distance, $1_1$, from the center axis of the flotation container to the center axis of the mixing pipe ranges preferably between 0.15 and 0.25, most suitably between 0.18 and 0.22, times the diameter, D, of the illustrated cross-section of the flotation cell. This cell or container is fashioned as a cylinder and has a basic body with an essentially circular cross-section. An elliptic cross-section is also suitable, in which case the ratio of the above-noted distance, $1_1$, relates to the horizontal diameter of the ellipse.

Cover plate 11 covers drain opening 9 and forms a drain channel 12 which extends along the inside of the container shell. Each flotation cell is defined in the container shell between one defining wall 19 and another defining wall 20, and cover plate 11 preferably extends from first defining wall 19 to second defining wall 20. Drain slots 13 and 14 are provided by cover plate 11 in the area of the flotation container cell. Upper drain slot 14 has a gap width ranging between 0.1 and 0.3 times, preferably between 0.2 and 0.3 times, the inside diameter of mixing pipe 1. The lower drain slot has a gap width ranging between 0.1 and 0.2 times the inside diameter of the mixing pipe 1. The wall of cover 11 is preferably bowed or may also be polygonal, as illustrated, so that its upper surface slants upward to prevent air from lodging in the drain channel 12.

The injector 5 features a perforated plate or orifice 3 preferably near the suspension surface, with air intake slots 4 and air channel 5 in the shell of the mixing pipe 1 between plate 3 and the suspension surface. Additionally, as illustrated by a dashed line, a central air intake tube 21 may extend through the perforated plate.

The illustrated arrangement produces a maximum flotation effect and maximum utilization of the entire container cross-section. Based on the percentage of the cross-sectional area occupied by the suspension, the container cross-section is extensively utilized, which considerably increases the suspension throughput without detracting from the flotation effect. In fact, the flotation effect is considerably improved, and thus the number of successive flotation cells can be reduced. It should be noted that the vertical component of the suspension draining downward must be smaller than the rate of ascent of the air bubbles in the suspension with adsorbed dirt particles. Neither dirt particles nor air bubbles should enter drain opening 9 in a significant quantity.

The illustrated structure uses a simple means and only a single injector to achieve a high flotation effect. Additionally the eccentric arrangement of the mixing pipe 1 provides a strong drain velocity component of the foam toward foam removal opening 6.

A flotation cell arrangement according to the above-noted German patent disclosure No. 31 20 202 required seven to eight cells in a flotation cell arrangement designed for a throughput of 11,000 l/min. However, the illustrated flotation cell arrangement has an identical volume and a throughput of 15,000 to 16,000 l/min, but only requires five to six cells.

While only a particular embodiment of the invention has been described herein, it is apparent that various modifications and alterations of the invention may be made. It is therefore the intention in the appended claims to cover all such modifications and alterations as may fall within the true spirit and scope of the invention.

We claim:

1. A flotation container for a liquid, which container has a shell with a bottom and a generally round, axial cross-section, a cross-sectional diameter, and a vertical center axis through said cross-section, which vertical center axis generally defines a first side and a second side of said container;

at least one injector with a point of air intake preceding a mixing pipe with a mouth for essentially horizontal discharge in said liquid and a central axis, which mixing pipe essentially vertically extends into said liquid;

a foam removal opening with an overflow edge arranged at an overflow edge height level above said container bottom;

a liquid drain communicating to said liquid through said shell, which foam removal opening and said liquid drain are located on one of said first side and second side;

said mixing pipe located on the container side opposite said liquid drain;

said mixing pipe central axis offset from and generally parallel to said vertical center axis at a distance between about 0.15 and 0.25 of the container cross-sectional diameter;

the mouth of said injector arranged above the container bottom at a mouth height level, which is below the overflow edge between about 0.3 and 0.5 times the overflow edge height; and, said liquid drain opening is generally arranged at approximately said container bottom.

2. Flotation cell according to claim 1, characterized in that the center axis of the mixing pipe is sideways offset relative to the vertical center axis of the container, away from the liquid drain side, between about 0.18 and 0.22 of the cross-sectional diameter of the container.

3. A flotation cell according to claim 2, characterized in that the mouth of one of the injector and mixing pipe is arranged at a distance below the overflow edge, which distance is between about 0.3 and 0.45 of said overflow edge height.

4. A flotation cell as claimed in claim 2, further comprising one of a bowed plate and an angular plate positioned in said container, said one plate covering said liquid drain opening and cooperating with said shell to define a liquid drain channel generally along said container lower, an upper liquid drain slot and a lower liquid drain slot.

5. A flotation cell as claimed in claim 4, wherein said mixing pipe defines an inside diameter and said upper drain slot and lower drain slot include drain slot widths, which upper drain slot width is between about 0.1 and 0.3 of said mixing pipe inside diameter and said lower drain slot width is between about 0.1 and 0.2 of said mixing pipe inside diameter.

6. A flotation cell as claimed in claim 4, further comprising a radial diffuser cooperating with said mixing pipe to define said mouth, which radial diffuser has an essentially horizontal discharge direction.

7. Flotation cell according to claim 2, wherein said upper drain slot width is between about 0.2 and 0.3 of the inside diameter of the mixing pipe.

8. A flotation cell as claimed in claim 2, further comprising a radial diffuser cooperating with said mixing pipe to define said mouth, which radial diffuser has an essentially horizontal discharge direction.

9. Flotation cell according to claim 1, characterized in that the mouth of one of the injector and mixing pipe is arranged at a distance below the overflow edge, which distance is between about 0.3 and 0.45 of said overflow edge height.

10. A flotation cell as claimed in claim 9, further comprising one of a bowed plate and an angular plate positioned in said container, said one plate covering said liquid drain opening and cooperating with said shell to define a liquid drain channel generally along said container lower, an upper liquid drain slot and a lower liquid drain slot.

11. A flotation cell as claimed in claim 10, further comprising a radial diffuser cooperating with said mixing pipe to define said mouth, which radial diffuser has an essentially horizontal discharge direction.

12. Flotation cell according to claim 9, wherein said upper drain slot width is between about 0.2 and 0.3 of the inside diameter of the mixing pipe.

13. A flotation cell as claimed in claim 9, further comprising a radial diffuser cooperating with said mixing pipe to define said mouth, which radial diffuser has an essentially horizontal discharge direction.

14. A flotation cell as claimed in claim 1, further comprising one of a bowed plate and an angular plate positioned in said container, said one plate covering said liquid drain opening and cooperating with said shell to define a liquid drain channel generally along said container bottom, an upper liquid drain slot and a lower liquid drain slot.

15. A flotation cell as claimed in claim 14, wherein said mixing pipe defines an inside diameter and said upper drain slot and lower drain slot include drain slot widths, which upper drain slot width is between about 0.1 and 0.3 of said mixing pipe inside diameter, and said lower drain slot width is between about 0.1 and 0.2 of said mixing pipe inside diameter.

16. A flotation cell as claimed in claim 15, further comprising a radial diffuser cooperating with said mixing pipe to define said mouth, which radial diffuser has an essentially horizontal discharge direction.

17. Flotation cell according to claim 14, wherein said upper drain slot width is between about 0.2 and 0.3 of the inside diameter of the mixing pipe.

18. A flotation cell as claimed in claim 17, further comprising a radial diffuser cooperating with said mixing pipe to define said mouth, which radial diffuser has an essentially horizontal discharge direction.

19. A flotation cell as claimed in claim 14, further comprising a radial diffuser cooperating with said mixing pipe to define said mouth, which radial diffuser has an essentially horizontal discharge direction.

20. A flotation cell as claimed in claim 1, further comprising a radial diffuser cooperating with said mixing pipe to define said mouth, which radial diffuser has an essentially horizontal discharge direction.

* * * * *